United States Patent [19]

Gourmel et al.

[11] Patent Number: 4,628,987

[45] Date of Patent: Dec. 16, 1986

[54] APPARATUS FOR CONTINUOUS VERTICAL CASTING OF IRON TUBE

[75] Inventors: Yves Gourmel; Michel Pierrel, both of Pont A Mousson, France

[73] Assignee: Pont-a-Mousson S.A., Nancy, France

[21] Appl. No.: 687,233

[22] Filed: Dec. 28, 1984

[30] Foreign Application Priority Data

Jan. 10, 1984 [FR] France ..... 84 00382

[51] Int. Cl.[4] ..... B22D 11/04; B22D 18/06

[52] U.S. Cl. ..... 164/254; 164/421

[58] Field of Search ..... 164/421, 422, 464, 465, 164/484, 254

[56] References Cited

U.S. PATENT DOCUMENTS

| | | | |
|---|---|---|---|
| 2,466,612 | 4/1949 | Phillips et al. | 164/421 |
| 4,000,773 | 1/1977 | Sevastakis | 164/421 |
| 4,146,079 | 3/1979 | Anisovich et al. | 164/421 X |
| 4,355,680 | 10/1982 | Frantzreb, Sr. | 164/421 X |
| 4,531,569 | 7/1985 | Fritscher | 164/464 |

FOREIGN PATENT DOCUMENTS

| | | | |
|---|---|---|---|
| 1136797 | 9/1962 | Fed. Rep. of Germany | 164/421 |
| 45-39344 | 12/1970 | Japan | 164/465 |
| 700277 | 12/1979 | U.S.S.R. | 164/464 |
| 816678 | 3/1981 | U.S.S.R. | 164/484 |
| 931282 | 5/1982 | U.S.S.R. | 164/421 |

*Primary Examiner*—Nicholas P. Godici
*Assistant Examiner*—J. Reed Batten, Jr.
*Attorney, Agent, or Firm*—Sughrue, Mion, Zinn, Macpeak and Seas

[57] ABSTRACT

In the continuous ascending vertical casting of an iron tube T without the use of a core to form the hollow tube interior, the molten iron is contained in a crucible made up of a cooled tubular die 6, 7 and the base 1 of a syphon unit. The crucible comprises a coaxial central form 5 at least as high as the die, which creates with the latter an annular space for molten iron F. Such arrangement reduces the volume of molten iron in the crucible and thus results in considerable energy savings.

8 Claims, 6 Drawing Figures

APPARATUS FOR CONTINUOUS VERTICAL CASTING OF IRON TUBE

BACKGROUND OF THE INVENTION

This invention relates to the continuous, ascending, vertical casting of a cast iron tube without the use of a core to form the hollow interior of the tube. More specifically, the invention concerns means for supplying molten metal to a tubular die defining the exterior shape of the tube, either from a syphon unit or from a gas-pressurized casting ladle.

In a known unit of this type as described in commonly assigned U.S. patent application Ser. No. 630,043 filed July 12, 1984, a tubular die having a vertical axis works together with a support stand that forms the die's base to create a crucible for molten metal brought up from below, either by a syphon unit or by a casting ladle. The crucible formed by the tubular die and the support stand contains a cylindrical volume of molten metal, the size of which increases with the diameter of the tube to be formed.

Applicants addressed the problem of considerably reducing the volume of molten iron that is to be brought to the lower end of the die in a unit designed for the continuous, ascending casting of a tube, in spite of the absence of a core, thereby realizing a substantial savings in terms of the energy needed to melt the metal.

SUMMARY OF THE INVENTION

The invention thus comprises an apparatus for the continuous, ascending, vertical casting of a metal tube, particularly one made of cast iron, of the type comprising a supply of molten metal fed in at the lower portion of a cooled die resting on a base, with the die forming a crucible together with the base in order to contain the molten metal. Inside the die and along its vertical axis the apparatus comprises a central form the height of which corresponds to the height of the die so as to form with the die an annular volume of molten metal, in the lower portion of which is found the mouth of at least one molten metal feed conduit.

By virtue of this arrangement, the crucible encompasses only a small annular quantity of molten metal, the annular width of which is much greater than the thickness of the tube to be formed despite the fact that the total volume is considerably less than that which would be contained in a crucible that did not have the central form.

In accordance with another important characteristic of the invention, the central form may contain a cavity that traverses it from one end to the other, enabling access through the cavity and above the form to the inside of the tube being formed, thus creating the possibility of inserting monitoring instruments for detecting the level of molten metal or the thickness of the tube being formed.

BRIEF DESCRIPTION OF THE DRAWINGS

In the attached drawings, which are provided solely by way of example.

DETAILED DESCRIPTION OF THE PREFERRED EMBODIMENTS

Figure 2:
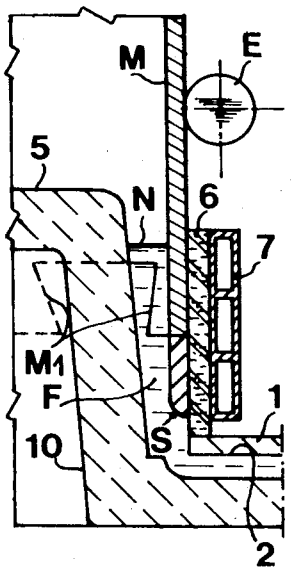
FIG. 2 is a partial cross-section corresponding to FIG. 1 and illustrating the use of a fake or dummy tube to begin the continuous casting.
Figure 1:
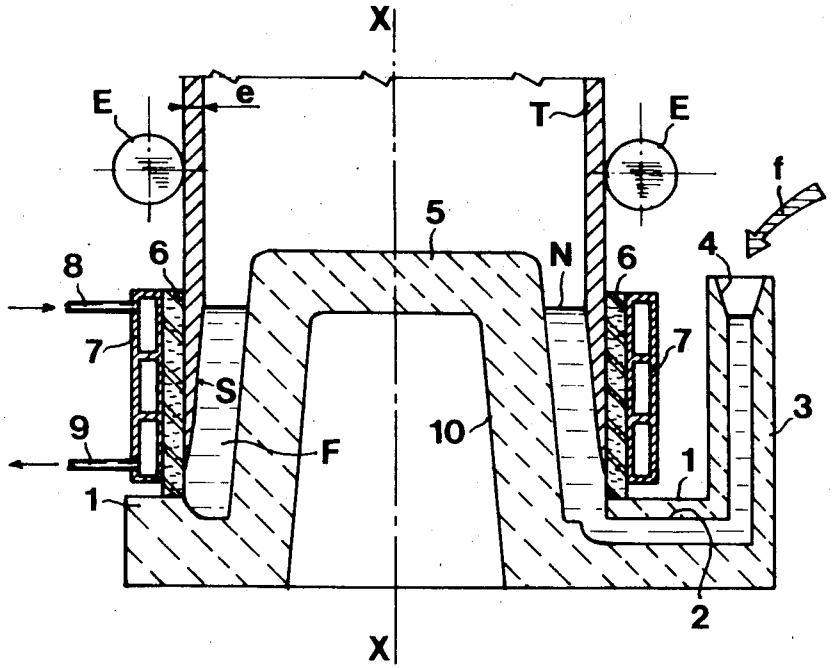
FIG. 1 is a schematic cross-section of the molten metal supply apparatus of the invention for the continuous casting of tubes without joints.
Figure 4:
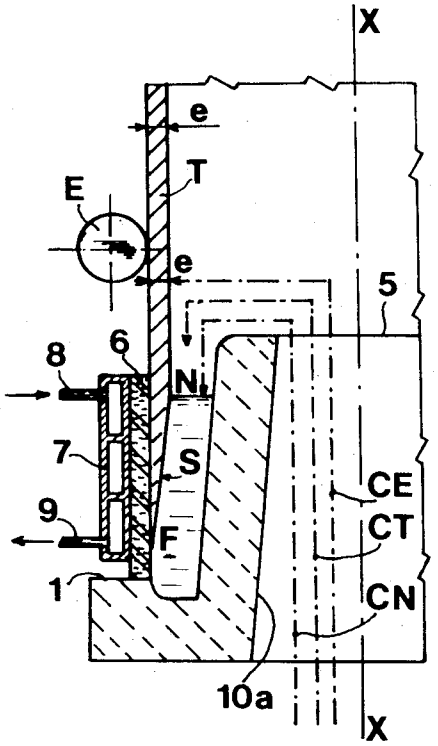
FIG. 4 is a partial cross-section corresponding to FIG. 1 and involving a variant in the central form, which has a cavity traversing it from one side to the other.

In the embodiment of FIGS. 1 and 2, the invention is applied to the continuous, ascending casting of an iron tube T. This arrangement comprises a molten metal feed employing a syphon unit, a crucible consisting of a cooled tubular die, and means (not shown) for withdrawing the formed tube.

Molten metal feed using syphon unit

A hollow stand 1 made of heatproof material, e.g., of silicoalumineous material, contains a horizontal or slightly oblique, L-shaped tap conduit 2 with a vertical upright 3 ending above in a tap funnel 4. The stand 1 of the syphon unit provides a base of support for the tubular die described below. In accordance with the invention, the syphon unit has a central form 5 in the shape of a truncated cone, said form having a vertical axis X—X and rising well above the stand 1 in height.

Outwardly cooled crucible (the die)

Stand 1 supports a crucible around axis X—X consisting of a tubular die comprising a graphite sleeve 6 with axis X—X, the inner diameter of which corresponds to the outer diameter of tube T being formed, and a jacket 7 which may be made of copper and through which circulates cooling water that enters through a conduit 8 and exits through a conduit 9.

The bottom end of the graphite sleeve 6 rests on stand 1 of the syphon unit, while the cooling jacket 7, which is in contact with the sleeve, envelops it over nearly all of its height, with the exception of the lower end of the sleeve which is not cooled. Cooling jacket 7 is therefore not in direct contact with stand 1. A heatproof annular spacing block may, but need not, be inserted between the cooling jacket and the stand.

The central form 5 is an integral part of the syphon unit and also forms a part of the crucible, and preferably extends higher than the die at the top of the stand. The truncated central form 5 has a large base at the bottom of the support formed by the stand 1. The diameter of the form is considerably less than the interior diameter one wishes to obtain in tube T being formed. A fortiori, then, the smaller upper base of form 5 has a considerably smaller diameter than that of the cavity of the tube being formed. In the present example central form 5 contains a weight-reducing cavity 10 which may be in the shape of a truncated cone. Such a cavity is not required, however.

Horizontal conduit 2 of the syphon unit opens out at the bottom of the crucible; the molten iron is thus brought to the lower end of the die, below the lower end of sleeve 6. The diameter of the mouth of the horizontal feed conduit 2 is smaller than the width of the annular space between the large lower base of central form 5 and the cylindrical cavity of the die.

The crucible thus contains a relatively small quantity of molten metal or iron by virtue of its being annular. The annular thickness of this volume of molten metal is appreciably greater than the thickness e of tube T being formed. Thus, form 5 does not serve as a core for the shaping of tube T. To the contrary, during the process of hardening the peripheral region of the annular volume of molten metal, a certain quantity thereof must remain between the solidifying periphery and the outer wall of the form. In the embodiment illustrated the lower end of the annular volume of molten metal contained between the central form 5 and the die has a radial thickness that is at least double the thickness e of tube T.

The unit is completed by means for vertically guiding tube T, which are partially represented by a pair of guide rollers E, and with an extractor (not shown) consisting of raising means designed to grip the upper end of finished tube T and raise it gradually using a stepped drive motor. Such guide and extraction means are in themselves known.

OPERATION—(FIGS. 1 AND 2)

Molten iron is introduced in the direction of arrow f into tap funnel 4. The syphon unit and crucible are filled until the molten iron F reaches a level slightly lower than the overall height of the die without overflowing. By a communicating vessel effect, the level N of molten iron is the same within the crucible and within upright 3. A current of cold water traverses sleeve 7.

To begin the production of tube T, a dummy tube M consisting of a tubular steel collar with essentially the same inner and outer dimensions and therefore essentially the same thickness e as tube T being formed is introduced within the die using guide rollers E to immerse the lower notched or dovetailed section M1 in the molten iron in order to allow the iron to adhere to it.

Since the greater portion of the die is cooled up to its upper extremity, the molten iron hardens upon contact with the die over the entire height covered by jacket 7 and up to dummy tube M, upon contact with which the molten iron also hardens. The thickness of the hardened iron along solidification surface S increases as the speed of feeding the molten iron from below decreases. Molten iron F fills notches M1, hardens, and thus holds fast to the dummy tube. Drawn upward by the extractor, the dummy rises in steps and draws the solidified portion of the iron upwards step-by-step.

When dummy tube M has drawn up a beginning section of tube T of sufficient height to be gripped between guide rollers E, the solidification surface S that is formed on the periphery of the annular volume of molten iron F assumes the truncated shape and size shown in FIG. 1, which corresponds to the total height of the molten iron that is surrounded by the cooling sleeve 7. The maximum hardened thickness is thus found at level N of the molten iron.

VARIANT (FIG. 3)

Figure 3:
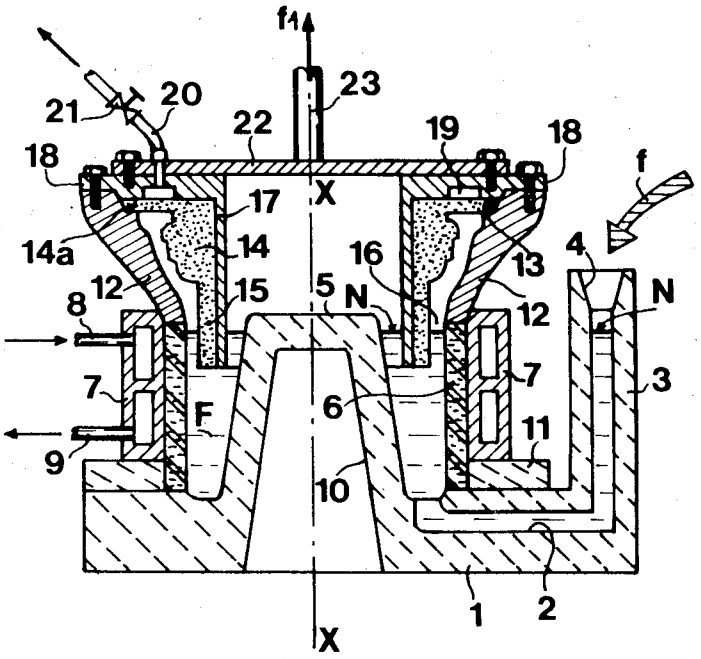
FIG. 3 is a cross-sectional view of the apparatus of the invention, similar to FIG. 1 but applied to the continuous casting of iron pipe with sockets.
Figure 6:
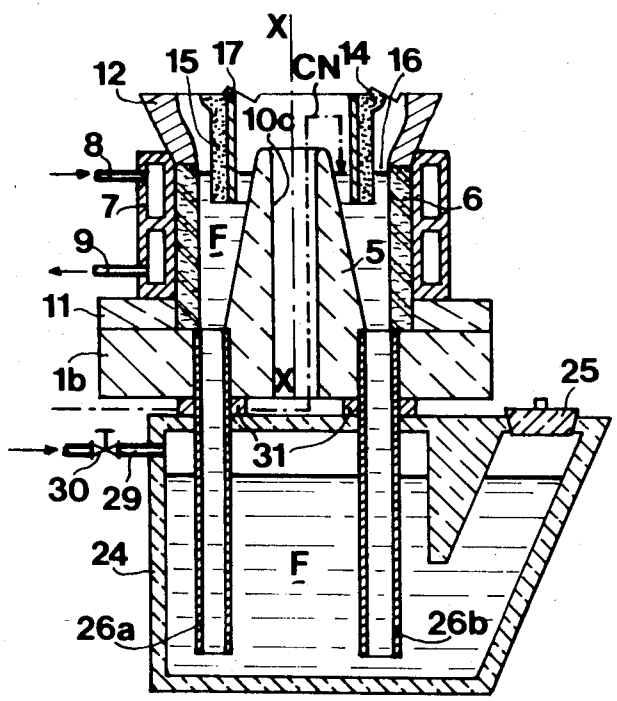
FIG. 6 is a partial view analogous to FIG. 5, showing a variant in the supply of molten metal from a pressurized casting ladle.

While in the example of FIG. 1 central form 5 is applied to a die designed to form a tube T without a joint, the variant in FIG. 3 is applied to the formation of a tube having an end joint in the form of a female bell housing. This variant derives from the installation described in U.S. patent application Ser. No. 630,043.

In this variant intended for the production of socketed iron pipe, the unit is analogous to that of FIG. 1 except that it also comprises means for forming the socket, as described in the '043 application. In the following description, elements identical or similar to those of FIG. 1 and playing the same role bear the same numerical references.

Between the cooling sleeve 7 and the stand 1 formed by the syphon unit is placed a heat insulating support plate 11 of silicoalumineous material; it is designed to prevent the stand 1 from being cooled by the sleeve 7.

The upper portion of sleeve 6 is surmounted or extended by an annular metal shell 12 which may be of steel, having axis X—X and flared at the top. This shell defines the exterior shape of the iron pipe socket. It is connected without discontinuity to both the inner and outer surfaces of sleeve 6. Shell 12 is cooled either by ambient air or by water jets, not shown.

Inside, a widened, truncated bearing surface 13 of shell 12 supports flange 14*a* of an annular socket core 14 made of heatproof molding material and permeable to air, e.g. a hardened mixture of sand and thermosetting resin. Core 14 defines the interior contour of the pipe socket. It comprises a tubular skirt 15 whose outer wall corresponds to the inner surface of the pipe that is to be molded. Skirt 15 extends downward beyond shell 12 and inward from the upper portion of the die. Skirt 15 thus forms with sleeve 6 of the die an annular space 16 that corresponds to the thickness of the pipe to be formed. Inside, core 14 includes an inner cover and tubular steel core 17 that is impermeable to air and resistant to the temperature of the molten iron.

To cause the iron to rise into the annular space 16 to form the socket as described below, the assembly of shell 12 and core 14 is equipped with suction means. The core 14 is fastened onto bearing surface 13 of shell 12 by an annular metal suction plate 18. Plate 18 comprises an annular suction channel 19 that opens onto flange 14*a* of core 14 above annular space 16. A conduit 20 flows into channel 19 and is connected through a valve 21 to a suction source (not shown). Suction plate 18 is fastened to shell 12 by screws.

In this variant the means for extracting the iron pipe being formed are not fully shown. They include a circular metal raising plate 22 fastened to plate 18 by screws, and integral with a rod 23 having axis X—X hanging from vertically guided raising means, not shown.

In this variant the central form 5 is sized such that its tip lies inside the cavity formed by skirt 15 and core 14 and above the upper end of die sleeve 6. It is advantageous that form 5 be higher than sleeve 6 in FIGS. 1 and 3 alike, since this makes it possible to limit the quantity of molten iron to an annular space along the entire height of the sleeve; if the central form were shorter than the sleeve there would be molten iron over its top, representing a useless excess and source of heat loss.

In operation, valve 21 of suction conduit 20 is closed. Molten iron is introduced into funnel 4 in the direction of arrow f. Molten iron F is brought to a level N at the upper portion of die sleeve 6, immersing skirt 15 and tubular core 17 but remaining below the top of central form 5.

With shell 12 in airtight contact with the upper section of sleeve 6, suction valve 21 is opened. The air contained in annular space 16 is evacuated through porous flange 14*a* of the core and through conduit 20 and channel 19, but not through impermeable steel core 17. The reduced pressure causes the molten iron to quickly fill the annular space 16 of the socket up to porous flange 14*a* of the core. Its level drops inside the cavity of impermeable core 17 and in upright 3, without dropping below the skirt 15. The socket that is thus formed hardens from the top down, i.e., starting from flange 14*a*.

To prepare for the extraction of the pipe, the level of molten iron, which has just dropped, is topped off by pouring more molten iron into funnel 4 while the socket hardens. When such hardening is sufficiently completed, suction valve 21 is closed. At this stage of solidification along front S (not shown but similar to that of FIG. 1), the extractor, i.e., the assembly of plate 22 and shell 12, is activated upward in the direction of arrow $f_1$ in FIG. 3 while molten iron is being poured into funnel 4 to replace the iron that has hardened above the die. Care is taken during extraction to keep the level N of molten iron constantly just below the upper portion of sleeve 6 and at a height at which the iron will still be cooled by jacket 7.

The hardened socket is extracted simultaneously with the raising of shell 12. These operations are performed discontinuously, in steps, as described in the '043 patent application. Below the socket and in continuity with it, the beginning of the tube T of thickness e hardens and grows longer with each cycle in the raising of the extractor assembly.

After obtaining a sufficient length of the pipe T being formed, molten iron is no longer poured into funnel 4 and the annular space between the die sleeve 6 and the central form 5 is quickly emptied through a lower opening (not shown) from which a plug has been removed. One then simply raises the formed pipe completely out of the die and removes its socket from shell 12, core 14 which is crumbled away, and suction plate 18.

In FIGS. 1 and 3, instead of being an integral part of the syphon unit 1–4, the central form 5 may be a separate unit that is connected to the syphon unit and sealed in place.

VARIANT (FIG. 4)

In an embodiment analogous to that of FIG. 1, the blind inner cavity of the hollow central form 5 is replaced by an open cavity 10*a* that axially traverses form 5 from end to end, opening at the top and outward on the lower surface of stand 1.

An advantageous result is that because the cavity 10*a* clears a passage from the outside into the interior of the tube T being formed, a monitoring instrument CN for measuring the level of molten metal, or an instrument CE for measuring the thickness of the tube being formed (by measuring its inner diameter while its outer diameter is known), or an instrument CT for measuring the temperature of the molten bath, may be inserted. Instruments CN, CT, and CE are represented symbolically by broken lines and are cited here as examples to illustrate the possibilities offered by having access into tube T through passageway 10*a*. With particular reference now to the measurement or detection of level N, given that this sample embodiment involves the supply of molten metal through a syphon unit with communicating vessels consisting of the crucible and the upright 3, level N may be detected or measured with certainty from the outside using upright 3, at least at times other than those used for replacing the molten iron. However, it will be seen that in other variants, where the system of communicating vessels is not available, that it is useful to be able to gain access from within to the level of the molten iron.

VARIANT (FIG. 5)

The system for supplying the molten iron is here modified. The syphon unit 1–4 is replaced with a pressurized casting ladle 24 of the type having an oblique filling channel closed by a cover 25. A vertical tap tube 26 made of refractory material passes through the upper wall of closed ladle 24. It reaches nearly to the bottom of the ladle and protrudes above the upper surface thereof for a short distance, following which it is surrounded and reinforced by a truncated nose-piece 27 having axis X—X connected with a complementary truncated socket 28 having axis X—X on the lower part of stand 1*a*, to enable tap tube 26 to communicate with cavity 10*b* or 10*c* of central form 5. In this example, the central form is hollowed out from end to end to form a cavity to enable the molten iron to rise up through it and spill over the top and into the crucible formed by the die sleeve and stand 1*a*.

Central form 5 may take the shape of a hollow truncated cone with a constant thickness and a cavity such as 10*b*. This creates a widened mass of hot molten iron in the lower, axial part of the central form. The central cavity and passageway of form 5 may also assume a cylindrical shape of the same diameter as the inner diameter of ascending tap tube 26, following the outline of broken lines 10*c*.

A conduit 29 in communication with the upper part of the interior of ladle 24, above the level of molten metal F, is connected to a source of compressed gas or to a vent controlled by valve 30. The variant of FIG. 5 has the advantage of permitting better control and even automation of the molten iron feed under the low pressure of a gas which may be air or an inert gas such as nitrogen or argon.

VARIANT (FIG. 6)

Figure 5:
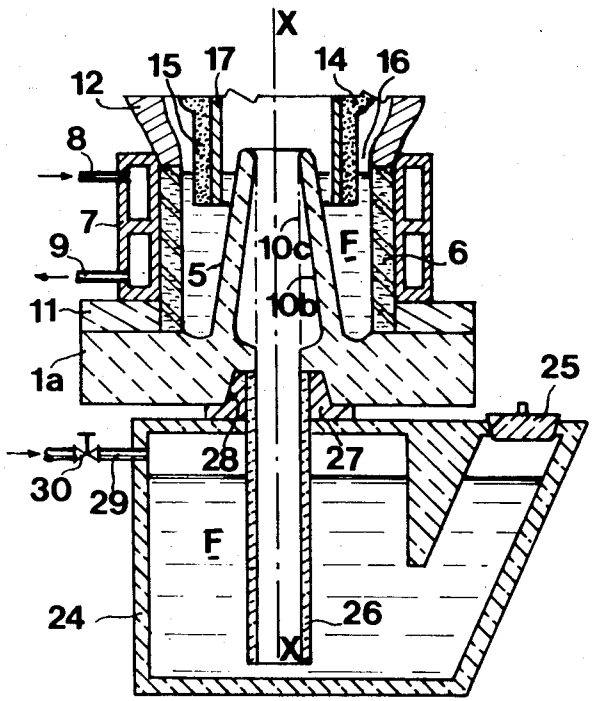
FIG. 5 is a cross-sectional view analogous to FIG. 3 and illustrating the continuous casting of a socketed pipe with ascending feed of the molten iron from a pressurized casting ladle.

In the case of molten metal feed using a casting ladle under low pressure analogous to that of FIG. 5, the single vertical tap tube 26 is replaced by a pair of ascending, vertical tap tubes 26*a* and 26*b* that pass through base 1*b* of the crucible stand and open out at the lower part of the crucible into the annular space between the central form 5 and die sleeve 6. In this example, truncated connector nozzle 27 is replaced by annular supporting and spacing chocks 31 surrounding each tube 26*a*, 26*b* and inserted between casting ladle 24 and stand 1*b*. The chocks 31 enable the lower part of axial cavity 10*c* of central form 5 to open out toward the outside and thereby create a passageway through which an instrument might gain access to the interior of the crucible, e.g., a level monitoring instrument CN.

This arrangement is particularly advantageous since it makes it possible to gain access to an interior space which is invisible because, in this example, it is contained between central form 5 and core 17 of socket core 14.

What is claimed is:

1. An apparatus for the continuous vertical casting of iron tubes, comprising:

(a) a crucible defined by a refractory base portion (1) and a cylindrical die sleeve (6) upstanding therefrom, (b) cooling means (7) surrounding the die sleeve, (c) a truncated conical refractory member (5) coaxially disposed within the die sleeve, upstanding from the base portion with a larger diameter lower portion contiguous with said base portion, defining an annular volume within the crucible for containing a casting charge of molten iron (F), and having an upper surface extending higher than an upper edge of the die sleeve and above a level (N) of molten iron charged into the crucible, and (d) feed conduit means (**2, 3, 4; 26*a*, 26*b***) separate and distinct from the conical member and having an outlet mouth in open communication with a bottom portion of said annular volume for supplying molten iron to the crucible, (e) said conical member serving to reduce the volume of molten iron chargeable into the crucible and the upper surface area of the molten iron to attendantly reduce the heat energy content of the molten iron and the escape of such heat energy from the upper surface of the molten iron by radiation.

2. An apparatus according to claim 1, wherein the sleeve is surmounted and extended upwardly by a pipe socket molding assembly comprising a shell (12) and an annular core (14) of air-permeable refractory material, and means (18, 19, 20, 21) for creating a low pressure in an annular space between the shell and the core, the conical member extending into the annular core and forming therewith an annular space for the molten iron.

3. An apparatus according to claim 1, wherein the conical member contains a hollow cavity (**10, 10*a*, 10*c***) open to the outside through a lower surface of the base portion.

4. An apparatus according to claim 3, wherein the cavity is blind.

5. An apparatus according to claim 3, wherein the feed conduit means is a syphon unit.

6. An apparatus according to claim 3, wherein the cavity of the conical member is in the shape of a truncated cone.

7. An apparatus according to claim 3, wherein the cavity extends completely through the conical member and opens out at the upper surface thereof.

8. An apparatus according to claim 7, wherein the feed conduit means comprises a pressurized casting ladle (24) located below said crucible and comprising two vertical, ascending tap tubes (**26*a*, 26*b*) extending into the casting ladle and opening at upper, mouth ends into the bottom portion of the annular volume, a lower surface of the base portion (1*b*) being separated from the casting ladle by support chocks (31**).

* * * * *